US007300529B2

(12) United States Patent
Kuehn et al.

(10) Patent No.: US 7,300,529 B2
(45) Date of Patent: Nov. 27, 2007

(54) HIGH-STRENGTH BERYLLIUM-FREE MOULDED BODY MADE FROM ZIRCONIUM ALLOYS WHICH MAY BE PLASTICALLY DEFORMED AT ROOM TEMPERATURE

(75) Inventors: Uta Kuehn, Possendorf (DE); Juergen Eckert, Darmstadt (DE); Ludwig Schultz, Dresden (DE)

(73) Assignee: Leibniz-Institut Fuer Festkoerper-und Werkstoffforschung Dresden e.V., Dresden (DE)

( * ) Notice: Subject to any disclaimer, the term of this patent is extended or adjusted under 35 U.S.C. 154(b) by 503 days.

(21) Appl. No.: 10/487,383

(22) PCT Filed: Aug. 12, 2002

(86) PCT No.: PCT/DE02/03030

§ 371 (c)(1),
(2), (4) Date: Mar. 29, 2004

(87) PCT Pub. No.: WO03/025242

PCT Pub. Date: Mar. 27, 2003

(65) Prior Publication Data

US 2004/0238077 A1 Dec. 2, 2004

(30) Foreign Application Priority Data

Aug. 30, 2001 (DE) ..... 101 43 683
Apr. 19, 2002 (DE) ..... 102 18 281

(51) Int. Cl.
*C22C 45/10* (2006.01)

(52) U.S. Cl. ..... 148/403; 148/421

(58) Field of Classification Search ..... 148/403, 148/561

See application file for complete search history.

(56) References Cited

U.S. PATENT DOCUMENTS 5,735,975 A 4/1998 Lin et al.
6,692,590 B2 * 2/2004 Xing et al. ..... 148/561
6,918,973 B2 * 7/2005 Hufnagel et al. ..... 148/538
2002/0003013 A1 * 1/2002 Hays ..... 148/561

FOREIGN PATENT DOCUMENTS

DE 198 33 329 1/2000
WO WO-00/68469 A2 * 11/2000

OTHER PUBLICATIONS

Kuhn, U. et al., "ZrNbCuNiAl bulk metallic glass matrix composites containing dendritic bcc precipitates", Applied Physics Letters, vol. 40, No. 14, Apr. 8, 2002, pp. 2478-2480.*

Greer, A.L., "From Metallic Glasses to Nanocrystalline Solids", Proceedings of the 22nd Riso International Symposium on Materials Science, Riso National Laboratory, Roskilde, Denmark, 2001, pp. 461-481.*

Kuehn U et al: "As-Cast Quasicrystalline Phase in a Zr-Based Multicomponent Bulk Alloy" Applied Physics Letters, American Institute of Physics. New York, US, vol. 77, No. 20, Nov. 13, 2000, pp. 3176, paragraphs 2, 3: figure 1, p. 3177, col. 2, line 26-line 29.

C. C. Hays, C. P. Kim, W. L. Johnson: "Improved mechanical behaviour of bulk metallic glasses containing in situ formed ductile phase dendrite dispersions" Materials Science and Engineering, May 31, 2001, pp. 650-655, XP00222028, the whole document.

Loeffler J F et al: "Crystallization of Bulk Amorphous Zr-Ti(Nb)-Cu-Ni-Al" Applied Physics Letters, American Institute of Physics, New York, US, vol. 77, No. 4, Jul. 24, 2000, pp. 525-527, XP000954870, ISSN: 0003-6951, the whole document.

Cang Fan, Chunfei Li, Akihisa Inoue: "Nanocrystal composites in Zr-Nb-Cu-Al metallic glasses" Journal of Non-Crystaline Solids, 2000, pp. 28-33, XP002222029, the whole document.

* cited by examiner

*Primary Examiner*—George P. Wyszomierski
(74) *Attorney, Agent, or Firm*—Jordan and Hamburg LLP

(57) ABSTRACT

High-strength, beryllium-free moulded bodies made from zirconium alloys which may be plastically deformed comprise a material essentially corresponding to the following formula in composition: $Zr_a(E1)_b(E2)_c(E3)_d(E4)_e$, where E1=one or several of Nb, Ta, Mo, Cr, W, Ti, V, Hf and Y, E2=one or several of Cu, Au, Ag, Pd and Pt, E3=one or several of Ni, Co, Fe, Zn and Mn, E4=one or several of AI, Ga, Si, P, C, B, Sn, Pb and Sb, a=100−(b+c+d+e), b=5 to 15, c=5 to 15, d=0 to 15 and e=5 to 15 (a, b, c, d, e in atom %). The moulded body essentially comprises a homogeneous, microstructural structure which is a glass-like or nanocrystalline matrix with a ductile, dendritic, cubic body-centered phase embedded therein.

28 Claims, No Drawings

HIGH-STRENGTH BERYLLIUM-FREE MOULDED BODY MADE FROM ZIRCONIUM ALLOYS WHICH MAY BE PLASTICALLY DEFORMED AT ROOM TEMPERATURE

BACKGROUND OF THE INVENTION

The invention relates to high-strength, beryllium-free, molded zirconium alloy objects which are plastically deformable at room temperature.

Such molded objects can be used as high-stressed components, for example, in the aircraft industry, in space travel and also in the automobile industry, but also for medical equipment and implants in the medical area, when the mechanical load-carrying capability, the corrosion resistance and the surface stresses must satisfy high requirements, especially in the case of components having a complicated shape.

It is well known that certain multicomponent, metallic materials can be transformed into a metastable, glassy state (metallic glasses) by rapid solidification, in order to obtain advantageous properties, such as soft magnetic, mechanical and/or catalytic properties. Because of the cooling rate required for the melt, most of these materials can be produced only with small dimensions in at least one direction, for example, as thin strips or powders. With that, they are unsuitable as solid construction materials (see, for example, B. T. Masumoto, Mater. Sci. Eng. A179/180 (1994) 8-16).

SUMMARY OF THE INVENTION

Furthermore, certain compositional ranges of multi-component alloys are known in which such metallic glasses can also be produced in solid form, for example, with dimensions greater then 1 mm, by casting processes. Such alloys are, for example, Pd—Cu—Si, $Pd_{40}Ni_{40}P_{20}$,Zn—Cu—Ni—Al, La—Al—Ni—Cu (see, for example, B. T. Masumoto, Mater. Sci. Eng. A179/180 (1994) 8-16 and W. L. Johnson in Mater. Sci. Forum Vol. 225-227, pages 35-50, Transtec Publications 1996, Switzerland).

Especially, beryllium-containing metallic glasses, which have a composition corresponding to the chemical formula $(Zr_{1-x}Ti_x)_{a1}ETM_{a2}(Cu_{1-y}Ni_y)_{b1}LTM_{b2}Be_c$, and dimensions greater than 1 mm, are also known (A. Peker, W. L. Johnson, U.S. Pat. No. 5,288,344). In this connection, the coefficient a1, a2, b1, b2, c, x, y refer to the content of the elements in atom percent, ETM is an early transition metal and LTM a late transition metal.

Furthermore, molded metallic glass objects, larger than 1 mm in all their dimensions, are known for certain composition rangers of the quinary Zr—Ti—Al—Cu—Ni alloys (L. Q. Xing et al. Non-Cryst. Sol 205-207 (1996) p. 579-601, presented at $9^{th}$ Int. Conf. on Liquid and Amorphous Metals, Chicago, Aug., 27 to Sep. 1, 1995; Xing et al., Mater. Sci. Eng. A 220 (1996) 155-161) and the pseudoquinary alloy $(Zr, Hf)_a(Al, Zn)_b(Ti, Nb)_c(Cu_xFe_y(Ni, Co)_z)_d$ (DE 197 06 768 06 768 A1; DE 198 33 329 C2).

A composition of a multi-component beryllium-containing alloy with the chemical formula $(Zr_{100-a-b}Ti_aNb_b)_{75}(Be_{x-}Cu_yNi_z)_{25}$ is also known. In this connection, the coefficients a and b refer to the proportion of the elements in atom percent with a=18.34 and b=6.66 and the coefficients x, y and z refer to the ratio in atom percent with x:y:z=9:5:4. This is a two-phase alloy; it has a brittle, glassy matrix of high strength and a ductile, plastically deformable, dendritic, cubic, body centered phase. As a result, there is an appreciable improvement in the mechanical properties at room temperature, particularly in the area of microscopic expansion (C. C. Hays, C. P. Kim and W. L. Johnson, Phys. Rev. Lett. 84, 13, p. 2901-2904 (2000)). However, the use of the highly toxic beryllium is a serious disadvantage of this alloy.

It is an object of the invention to make a beryllium-free, high strength, and plastically deformable, molded objects of zirconium alloys available which, in comparison to the aforementioned metallic glasses, have macroscopic plasticity and deformation consolidation during shaping processes at room temperature, without a significant effect on other properties such as strength, elastic expansion or corrosion behavior.

DESCRIPTION OF THE PREFERRED EMBODIMENTS

The inventive molded objects comprise a material, the composition of which corresponds to the formula:

$$Zr_a(E1)_b(E2)_c(E3)_d(E4)_e$$

in which:

E1 is an element or several elements of the group formed by the elements Nb, Ta, Mo, Cr, W, Ti, V, Hf, and Y, E2 is an element or several element of the group formed by the elements Cu, Au, Ag, Pd and Pt, E3 is an element or several element of the group formed by the elements Ni, Co, Fe, Zn and Mn, and E4 is an element or several element of the group formed by the elements Al, Ga, Si, P, C, B, Sn, Pb and Sb;

with:

a=100−(b+c+d+e)

b=5 to 15 c=5 to 15 d=0 to 15 e=5 to 15

(a, b, c, d, e in atom percent)

and optionally with small additions and impurities as required by the manufacturing process.

A further characterizing, distinguishing feature consists therein that the molded objects have a homogenous, microstructural structure, which consists of a glassy or nanocrystalline matrix, in which a ductile, dendritic, cubic, body-centered phase is embedded, a third phase possible being contained in a proportion by volume not exceeding 10 percent.

It is advantageous if the material contains the element Nb as E1, the element Cu as E2, the element Ni as E3 and the element Al as E4.

In order to realize particularly advantageous properties the material should have a composition with b=6 to 10, c=6 to 11, d=0 to 9 and e=7 to 12.

A composition with the ratios of Zr:Nb=5:1 to 11:1 and Zr:Al=6:1 to 9:1 is advantageous.

The dendritic, cubic, body-centered phase, contained in the material, should advantageously have a composition with b=7 to 15, c=3 to 9, d=0 to 3 and e=7 to 10 (numerical data in atom percent). A material with particular good properties comprises $Zr_{66.4}Nb_{6.4}Cu_{10.5}Ni_{8.7}Al_8$ (numerical data in atom percent).

A further material with particular good properties comprises $Zr_{71}Nb_9Cu_8Ni_1Al_{11}$ (numerical data in atom percent).

Pursuant to the invention, the proportion by volume of the dendritic, cubic, body-centered phase, formed in the matrix, is 25 to 95 percent and preferably 50 to 95 percent.

The length of the primary dendritic axes ranges from 1 μm to 100 μm and the radius of the primary dendrites is 0.2 μm to 2 μm.

For preparing the molded object, a semi finished product or the finished casting is prepared by casting the melted zirconium alloy into a copper mold.

The detection of the dendritic, cubic, body-centered phase in the glassy or nanocrystalline matrix and the determination of the size and proportion by volume of the dendritic precipitates can be made by x-ray diffraction, scanning electron microscopy or transmission electron microscopy.

The invention is explained in greater detail below by means of examples.

EXAMPLE 1

An alloy, having the composition $Zr_{71}Nb_9Cu_8Ni_1Al_{11}$ (numerical data in atom percent) is cast in a cylindrical copper mold having an internal diameter of 5 mm. The molded object comprises a glass-like matrix in which a ductile, cubic, body-centered phase is embedded. The proportion by volume of the dendritic phase is about 50%. By these means, an elongation at break of 3.5% at a breaking strength of 1791 MPa is achieved. The elastic elongation at the technical yield point (0.2% yield strength) is 2.5% at a strength of 1638 MPa. The modulus of elasticity is 72 GPa.

EXAMPLE 2

An alloy, having the composition $Zr_{71}Nb_9Cu_8Ni_1Al_{11}$, (numerical data in atom percent) is cast in a cylindrical copper mold having an internal diameter of 3 mm. The molded object obtained comprises a nanocrystalline matrix in which a ductile, cubic, body-centered phase is embedded. The proportion by volume of the dendritic phase is about 95%. By these means, an elongation at break of 5.4% at a breaking strength of 1845 MPa is achieved. The elastic elongation at the technical yield point (0.2% yield strength) is 1.5% at a strength of 1440 MPa. The modulus of elasticity is 108 GPa.

EXAMPLE 3

An alloy, having the composition $Zr_{66.4}Nb_{4.4}Mo_2Cu_{10.5}Ni_{8.7}Al_8$(numerical data in atom percent) is cast in a cylindrical copper mold having an internal diameter of 5 mm. The molded object obtained comprises a glass-like matrix in which a ductile, cubic, body-centered phase is embedded. The proportion by volume of the dendritic phase is about 50 percent. By these means, an elongation at break of 3.4% at a breaking strength of 1909 MPa is achieved. The elastic elongation at the technical yield point (0.2 percent yield strength) is 2.1% at a strength of 1762 MPa. The modulus of elasticity is 94 GPa.

EXAMPLE 4

An alloy, having the composition $Zr_{70}Nb_{10.5}Cu_8Ni_2Al_{9.5}$ (numerical data in atom percent) is cast in a cylindrical copper mold having an internal diameter of 3 mm. The molded object obtained comprises a nanocrystalline matrix in which ductile, cubic, body-centered phase is embedded. The proportion by volume of the dendritic phase is about 95 percent. By these means, an elongation at break of 6.2% at a breaking strength of 1680 MPa is achieved. The elastic elongation at the technical yield point (0.2% yield strength) is 1.9% at a strength of 1401 MPa. The modulus of elasticity is 84 GPa.

What we claim is:

1. High strength, beryllium-free, molded zirconium alloy object, which is plastically deformable at room temperature, wherein the molded object comprises a material, a composition of which corresponds to the formula:

$$Zr_a(E1)_b(E2)_c(E3)_d(E4)_e$$

in which:

E1 is an element or several elements selected from the group consisting of Nb, Ta, Mo, Cr, W, Ti, V, Hf, and Y, E2 is an element or several elements selected from the group consisting of Cu, Au, Ag, Pd and Pt, E3 is an element or several elements selected from the group consisting of Ni, Co, Fe, Zn and Mn, and E4 is an element or several elements selected from the group consisting of Al, Ga, Si, P, C, B, Sn, Pb and Sb, wherein a=100−(b+c+d+e)

b=5 to 15 c=5 to 15 d=0 to 15 e=5 to 15

(a, b, c, d, e in atom percent);

the molded object has a homogenous, microstructural structure, which comprises a glassy or nanocrystalline matrix, in which a ductile, dendritic, cubic, body-centered phase is embedded; and the dendritic, cubic, body-centered phase contained in the material has a composition of $Zr_f(E1)_g(E2)_h(E3)_i(E4)_j$ with g=7 to 15, h=3 to 9, i=0 to 3 and j=7 to 10, and E1, E2, E3, and E4 as defined above, and f=100−(g+h+i+j).

2. The molded object of claim 1, wherein b=6 to 10, c=6 to 11, d=0 to 9 and e=7 to 12.

3. The molded object of claim 1, wherein the composition of the material is $Zr_{71}Nb_9Cu_8Ni_1Al_{11}$ (numerical data in atom percent).

4. The molded object of claim 1, wherein the proportion by volume of the dendritic, cubic, body-centered phase, formed in the matrix is 25 percent to 95 percent.

5. The molded object of claim 1, wherein the length of the primary dendritic axes in the dendritic, cubic, body-centered phase range from 1 μm to 100 μm and the radius of the primary dendrites ranges from 0.2 μm to 2 μm.

6. The molded object of claim 1, wherein the proportion by volume of the dendritic, cubic, body-centered phase formed in the matrix is 50 percent to 95 percent.

7. The molded object of claim 1, further comprising another phase, said another phase being less than 10% of the volume of said molded object.

8. The molded object of claim 1, wherein said material comprises impurities from a manufacturing process.

9. The molded object of claim 1, wherein E2 is an element or several elements selected from the group consisting of Au, Ag, Pd and Pt.

10. High strength, beryllium-free, molded zirconium alloy object, which is plastically deformable at room temperature, wherein the molded object comprises a material, a composition of which corresponds to the formula $$Zr_a(E1)_b(E2)_c(E3)_d(E4)_e$$

in which:

E1 is an element or several elements selected from the group consisting of Nb, Ta, Mo, Cr, W, Ti, V, Hf, and Y, E2 is an element or several elements selected from the group consisting of Cu, Au, Ag, Pd and Pt, E3 is an element or several elements selected from the group consisting of Ni, Co, Fe, Zn and Mn, and E4 is an element or several elements selected from the group consisting of Al, Ga, Si, P, C, B, Sn, Pb and Sb, wherein a=100−(b+c+d+e)

b=5 to 15 c=5 to 15 d=0 to 15 e=5 to 15

(a, b, c, d, e in atom percent);

and the molded object has a homogenous, microstructural structure, which comprises a nanocrystalline matrix, in which a ductile, dendritic, cubic, body-centered phase is embedded.

11. The molded object of claim 10, in which the material contains the element Nb as E1, the element Cu as E2, the element Ni as E3 and the element Al as E4.

12. The molded object of claim 10, wherein b=6 to 10, c=6 to 11, d=0 to 9 and e=7 to 12.

13. The molded object of claim 10, wherein the dendritic, cubic, body-centered phase contained in the material has a composition of $Zr_f(E1)_g(E2)_h(E3)_i(E4)_j$ with g=7 to 15, h=3 to 9, i=0 to 3 and j=7 to 10, and E1, E2, E3, and E4 as defined in claim 10 above, and f=100−(g+h+i+j).

14. The molded object of claim 10, wherein the composition of the material is $Zr_{66.4}Nb_{6.4}Cu_{10.5}Ni_{8.7}Al_8$(numerical data in atom percent).

15. The molded object of claim 10, wherein the composition of the material is $Zr_{71}Nb_9Cu_8Ni_1Al_{11}$(numerical data in atom percent).

16. The molded object of claim 10, wherein the proportion by volume of the dendritic, cubic, body-centered phase formed in the matrix is 25 percent to 95 percent.

17. The molded object of claim 10, wherein the length of the primary dendritic axes in the dendritic, cubic, body-centered phase range from 1 μm to 100 μm and the radius of the primary dendrites ranges from 0.2 μm to 2 μm.

18. The molded object of claim 10, wherein the proportion by volume of the dendritic, cubic, body-centered phase formed in the matrix is 50 percent to 95 percent.

19. The molded object of claim 10, further comprising another phase, said another phase being less than 10% of the volume of said molded object.

20. The molded object of claim 10, wherein said material comprises impurities from a manufacturing process.

21. High strength, beryllium-free, molded zirconium alloy object, which is plastically deformable at room temperature, wherein the molded object comprises a material, a composition of which corresponds to the formula $$Zr_a(E1)_b(E2)_c(E3)_d(E4)_e$$

in which:

E1 is Nb

E2 is Cu

E3 is Ni

E4 Al, wherein a=100 (b+c+d+e)

b=5 to 15 c=5 to 15 d=0 to 15 e=5 to 15

(a, b, c, d, e in atom percent);

and the molded object has a homogenous, microstructural structure, which comprises a glassy matrix, in which a ductile, dendritic, cubic, body-centered phase is embedded.

22. The molded object of claim 21, wherein the composition of the material is $Zr_{66.4}Nb_{6.4}Cu_{10.5}Ni_{8.7}Al_8$(numerical data in atom percent).

23. The molded object of claim 21, wherein the proportion by volume of the dendritic, cubic, body-centered phase formed in the matrix is 25 percent to 95 percent.

24. The molded object of claim 21, wherein the length of the primary dendritic axes in the dendritic, cubic, body-centered phase range from 1 μm to 100 μm and the radius of the primary dendrites ranges from 0.2 μm to 2 μm.

25. The molded object of claim 21, wherein the proportion by volume of the dendritic, cubic, body-centered phase formed in the matrix is 50 percent to 95 percent.

26. The molded object of claim 21, further comprising another phase, said another phase being less than 10% of the volume of said molded object.

27. The molded object of claim 21, wherein said material comprises impurities from a manufacturing process.

28. The molded object of claim 21, wherein the composition of the material is $Zr_{71}Nb_9Cu_8Ni_1Al_{11}$(numerical data in atom percent).

* * * * *